US006637037B1

(12) United States Patent
Hung

(10) Patent No.: US 6,637,037 B1
(45) Date of Patent: Oct. 28, 2003

(54) READY SAFETY HELMET

(76) Inventor: Chichuan Hung, 11F-3, No. 575, Lin-Sen N. Rd. Chung-Shan Dist., Taipei (TW)

( * ) Notice: Subject to any disclaimer, the term of this patent is extended or adjusted under 35 U.S.C. 154(b) by 0 days.

(21) Appl. No.: 10/145,025

(22) Filed: May 15, 2002

(51) Int. Cl.[7] ..... A42B 3/00
(52) U.S. Cl. ..... 2/413
(58) Field of Search ..... 2/413, DIG. 3, 2/DIG. 10, 414, 411, 410, 425, 10

(56) References Cited

U.S. PATENT DOCUMENTS 2,121,702 A * 6/1938 Larkin ..... 2/413
3,953,892 A * 5/1976 Kennedy et al. ..... 2/425
4,324,005 A * 4/1982 Willis ..... 2/413
4,354,283 A * 10/1982 Gooding ..... 2/413
4,827,537 A * 5/1989 Villa ..... 2/410
5,337,420 A * 8/1994 Haysom et al. ..... 2/410
5,628,071 A * 5/1997 Nezer ..... 2/410
6,532,602 B2 * 3/2003 Watters et al. ..... 2/411

* cited by examiner

*Primary Examiner*—Rodney M. Lindsey
(74) *Attorney, Agent, or Firm*—Troxell Law Office

(57) ABSTRACT

Ready safety helmet including two cover boards pivotally connected with each other and inflatable envelope overlaid on the upper and lower faces of the cover boards. When the inflatable envelope is deflated, the cover boards are pivoted to attach to each other so as to reduce the volume for easy carriage and storage. After the cover boards are outward stretched and fixed, the inflatable envelope is inflated. Thereafter, a user can wear the helmet on the head. By means of the buffing ability of the soft envelope and the anti-impact ability of the hard cover boards, the user's head is protected from being collided by an alien article.

30 Claims, 5 Drawing Sheets

READY SAFETY HELMET

BACKGROUND OF THE INVENTION

The present invention is related to a ready safety helmet including two cover boards pivotally connected with each other and an inflatable envelope overlaid on the upper and lower faces of the cover boards. After the cover boards are outward stretched and fixed by elbow supporting members, the inflatable envelope is inflated. Thereafter, a user can wear the helmet on the head. By means of the buffing ability of the soft envelope and the anti-impact ability of the hard cover boards, the safety helmet can readily provide double protective effects for a user's head under an emergent circumstance. When not used, the inflatable envelope is deflated and the elbow supporting members are folded to minimize the volume of the safety helmet for easy carriage.

A conventional safety helmet has a rigid casing with fixed shape for shielding and protecting a user's head. Such helmet cannot be folded or collapsed to reduce the volume. Therefore, it is inconvenient to carry or store such helmet. As a result, a user is often unwilling to carry the helmet. When encountering an emergency, the user may lack the helmet and put himself in danger. There are many situations and environments necessitating safety helmet. For example, when riding a motorbike, entering a construction site or encountering an earthquake, anyone may need a ready safety helmet for protecting the head. In the case that the user fails to carry any safety helmet with him, the user may get hurt.

SUMMARY OF THE INVENTION

It is therefore a primary object of the present invention to provide a ready safety helmet including two cover boards pivotally connected with each other and an inflatable envelope overlaid on the upper and lower faces of the cover boards. Multiple elbow supporting members are connected between the cover boards for supporting the same. The cover boards can be stretched and fixed by the elbow supporting members. Thereafter, the inflatable envelope is inflated and a user can wear the helmet on the head. By means of the buffing ability of the soft envelope and the anti-impact ability of the hard cover boards, the safety helmet can readily provide double protective effects for a user's head under an emergent circumstance. When not used, the inflatable envelope is deflated and the elbow supporting members are folded to minimize the volume of the safety helmet for easy carriage and storage.

It is a further object of the present invention to provide the above ready safety helmet in which a protective spectacle is disposed on front side of the cover boards for protecting the eyes of a user.

The present invention can be best understood through the following description and accompanying drawings wherein:

DETAILED DESCRIPTION OF THE PREFERRED EMBODIMENTS

Figure 1:
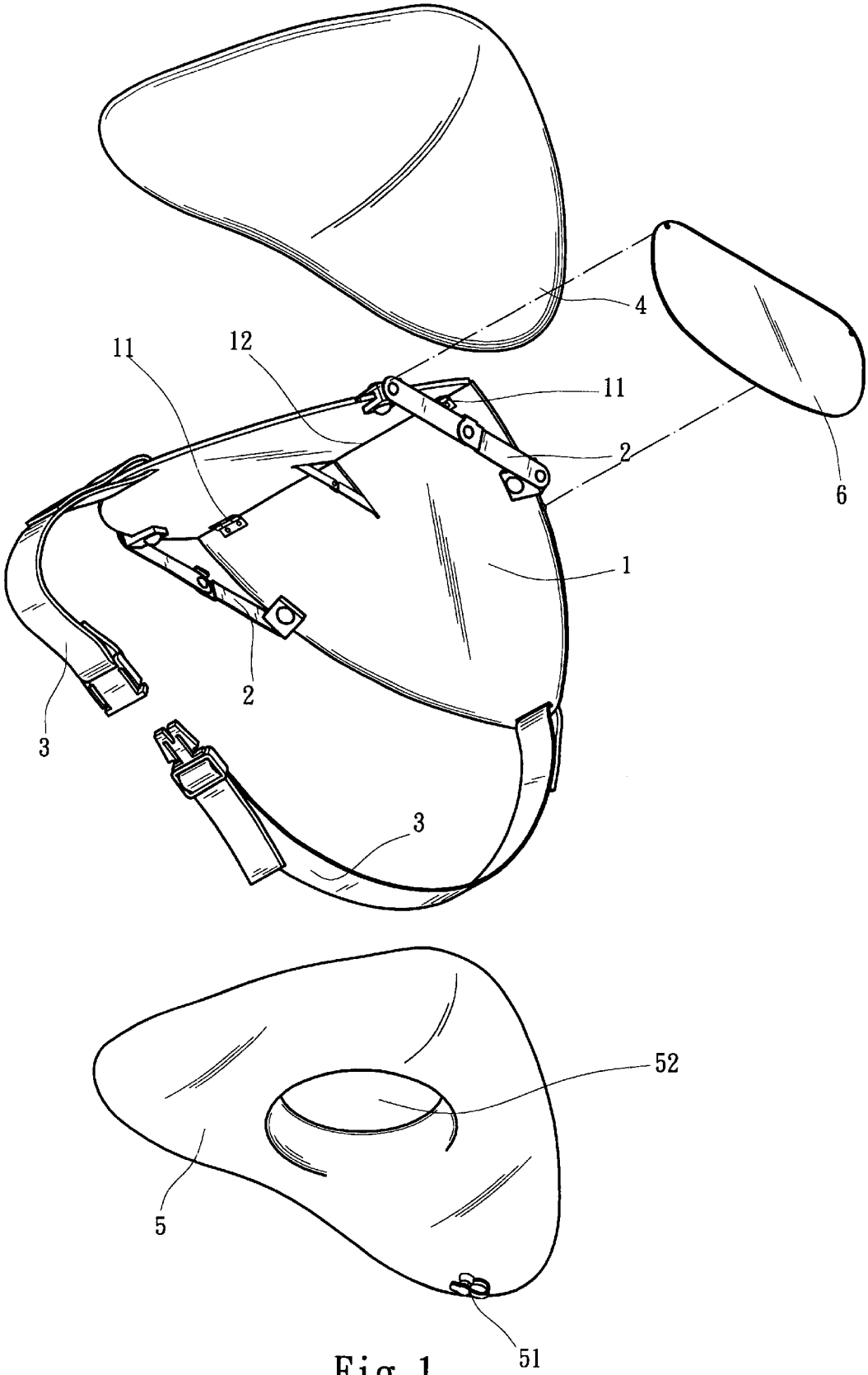
FIG. 1 is a perspective exploded view of the safety helmet of the present invention.
Figure 2:
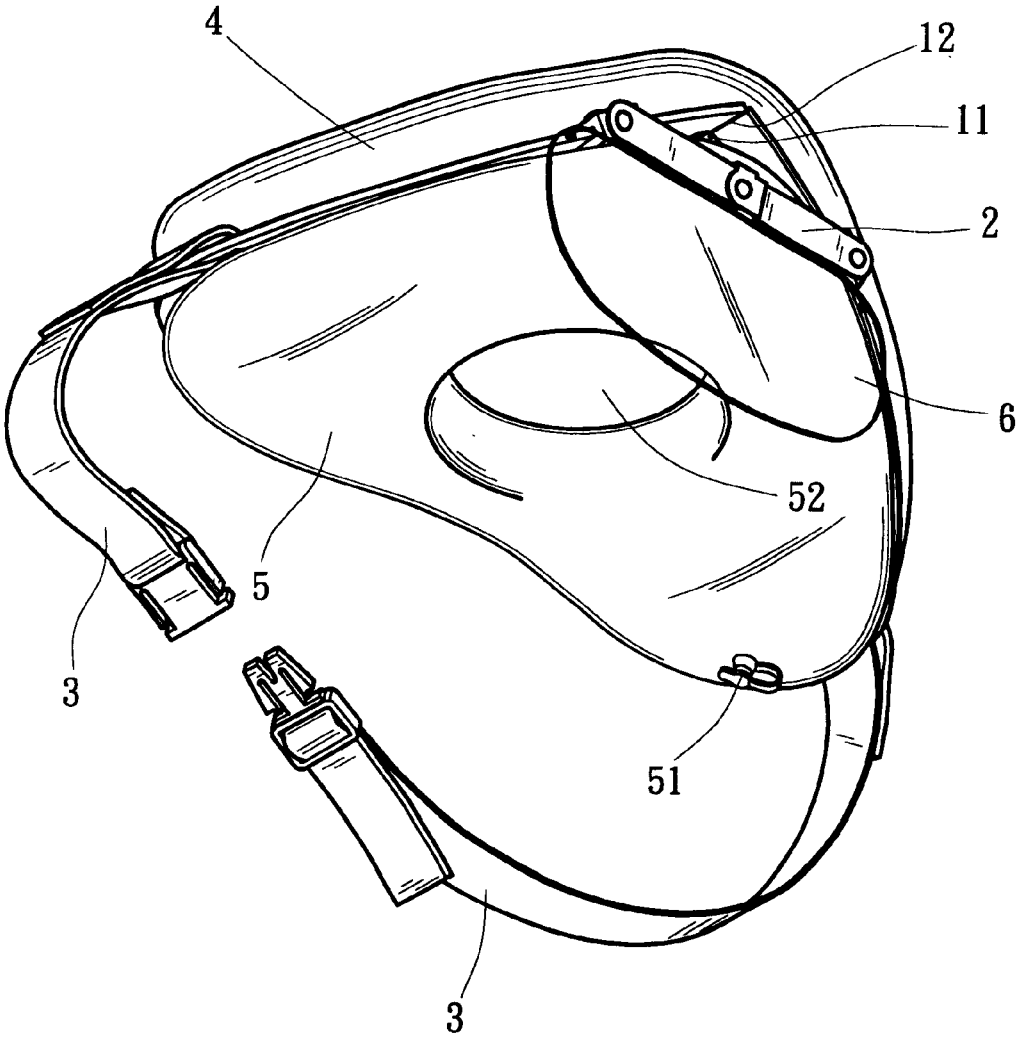
FIG. 2 is a perspective assembled view of the safety helmet of the present invention.
Figure 3:
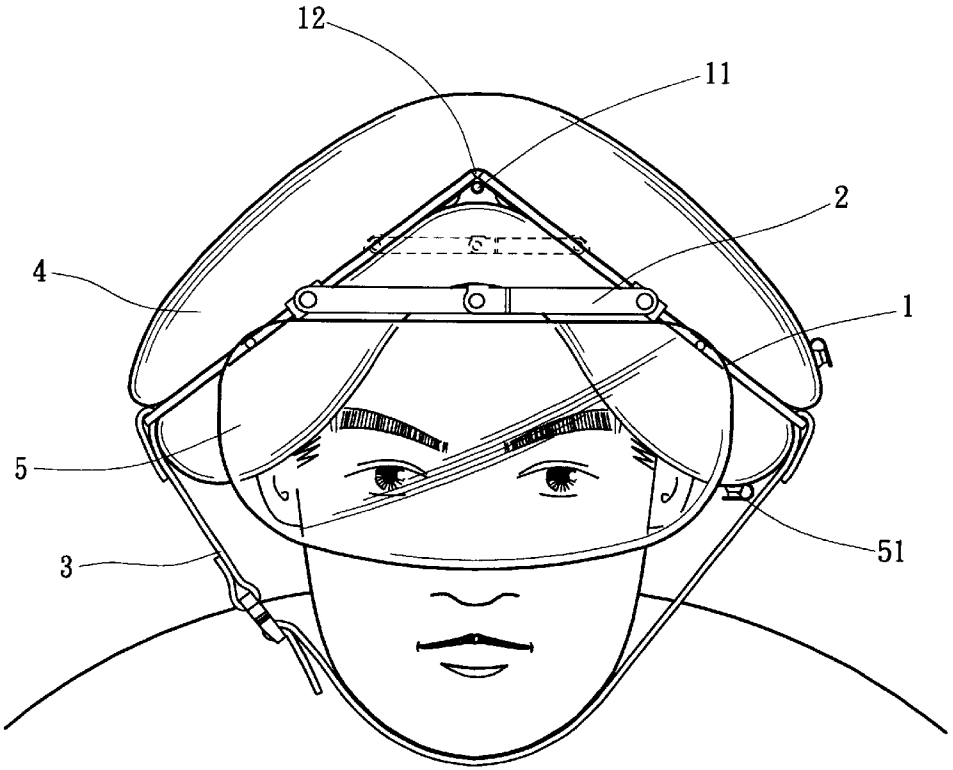
FIG. 3 shows the use of the safety helmet of the present invention.
Figure 4:
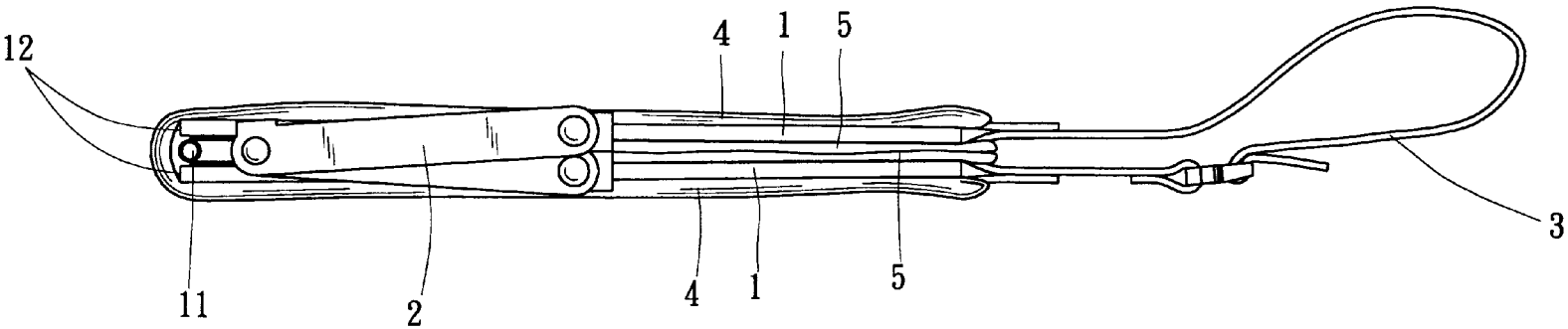
FIG. 4 is a plane view showing that the safety helmet of the present invention is folded.
Figure 5:
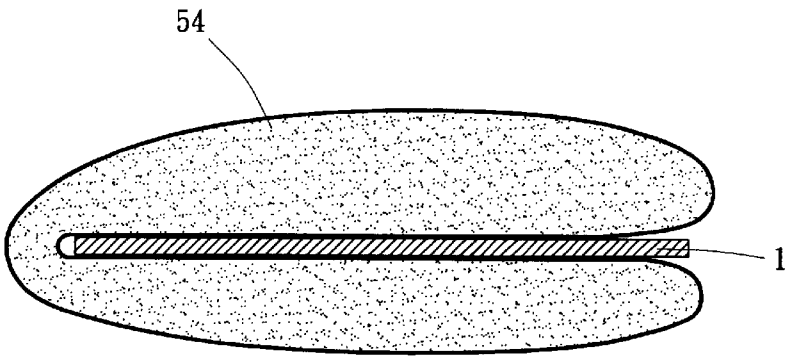
FIG. 5 is a plane view of another embodiment of the inflatable envelope of the safety helmet of the present invention.
Figure 6:
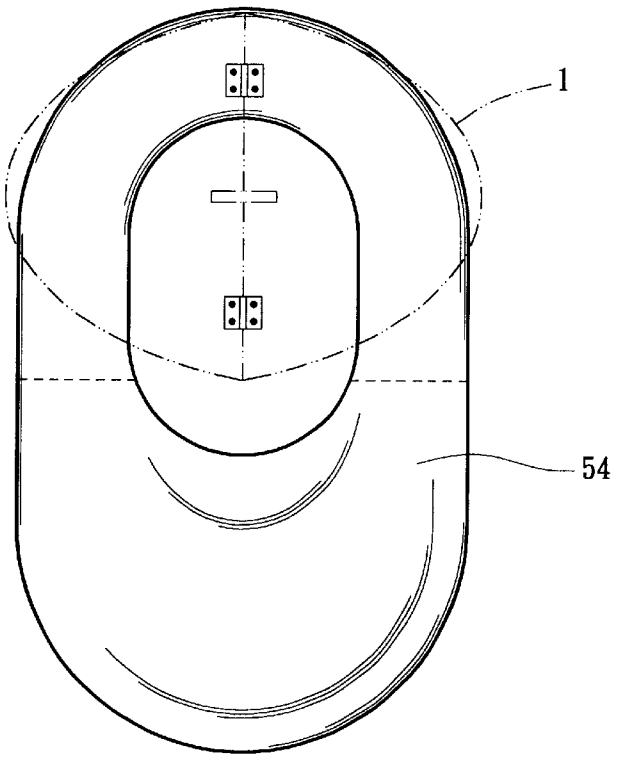
FIG. 6 is a top view according to FIG. 5, showing that the inflatable envelope is assembled with the cover boards of the present invention.

Please refer to FIGS. 1 to 4. The ready safety helmet of the present invention includes two cover boards 1, elbow supporting members 2, two fastening straps 3, an upper inflatable envelope 4 and a lower inflatable envelope 5. Two edges 12 of the cover boards 1 are pivotally connected by multiple hinges 11. In addition, the elbow supporting members 2 are bridged over the edges 12 and connected between the cover boards 1 to support the same. The elbow supporting members 2 can be bent or stretched to one single side. After stretched, the cover boards 1 are fixed at a certain open angle to form a cap pattern. The upper inflatable envelope 4 and lower inflatable envelope 5 can have different configurations as necessary as shown in FIGS. 1 and 5. In FIG. 1, the upper inflatable envelope 4 and lower inflatable envelope 5 are respectively fixedly disposed on upper and lower faces of the cover boards 1. Each of the upper inflatable envelope 4 and lower inflatable envelope 5 is formed with at least one nozzle 51 for inflating or deflating the envelopes 4, 5. (The nozzle of the upper inflatable envelope 4 is not shown.) The nozzle 51 can be connected to an automatic inflator for quickly inflating the envelope. The center of bottom side of the lower inflatable envelope 5 is formed with a depression 52 which can be a circular depression. In FIG. 5, the upper inflatable envelope 4 and the lower inflatable envelope 5 are integrally formed into an inflatable envelope 54 overlaid on the upper and lower faces of the cover boards 1. The inflatable envelope 54 is formed with at least one band-shaped connecting envelope on rear side of the hinged edges of the cover boards 1 corresponding to the position of the elbow supporting member 2 bridged between the cover boards 1. Accordingly, the bending operation of the elbow supportingmember 2 will not be affected. By means of the connecting envelope, the interiors of the upper and lower inflatable envelopes 4, 5 are communicated with each other and one nozzle 52 is directly disposed on one of the envelopes 4, 5 for inflating or deflating the envelope 54. A protective spectacle 6 is disposed on front side of the hinged edges of the cover boards 1 for protecting the eyes of a user. The protective spectacle 6 is simply connected with the front side of the cover boards 1 by way of latching measure, whereby the user can easily install or detach the protective spectacle 6. Two fastening straps 3 are respectively disposed at outer ends of the cover boards 1 (or the inflatable envelope). The fastening straps 3 are equipped with fasteners for fastening the fastening straps 3. The cover boards 1 are outward stretched and supported by the elbow supporting members 2. The inflatable envelopes 4, 5 are inflated. Thereafter, a wearer's head is accommodated and located in the depression 52 of the lower inflatable envelope 5. The fastening straps 3 can fasten the cover boards 1 on the wearer's head. By means of the softness of the envelopes and the hardness of the cover boards 1, a good buffing and anti-pressure effect is provided for protecting a user's head from being collided by an alien article. When the inflatable envelopes 4, 5 are deflated and the elbow supporting members 2 are folded, the volume of the cover boards 1 and the inflatable envelopes 4, 5 can be greatly reduced to facilitate carriage and storage. The safety helmet can be readily taken out and used.

The above embodiments are only used to illustrate the present invention, not intended to limit the scope thereof.

Many modifications of the above embodiments can be made without departing from the spirit of the present invention.

What is claimed is:

1. Ready safety helmet comprising two cover boards, elbow supporting members and an inflatable envelope, the cover boards being pivotally connected by multiple hinges, the elbow supporting members being bridged over the hinged edges of the cover boards and connected between the cover boards to support the same, the elbow supporting members being bendable or stretchable to one single side, the inflatable envelope being disposed under bottom side of the cover boards and formed with a simple nozzle, whereby when the elbow supporting members are fully stretched and located, the cover boards are stretched to form a cap pattern and after the inflatable envelope is inflated, the envelope and the cover boards form an anti-collision helmet for a user to wear on the head, the helmet providing buffing and protective effect for the user's head, after the inflatable envelope is deflated and the elbow supporting members are folded, the volume of the cover boards and the inflatable envelope being greatly reduced to facilitate carriage and ready use.

2. Ready safety helmet as claimed in claim 1, wherein an upper inflatable envelope is disposed on upper side of the cover boards.

3. Ready safety helmet as claimed in claim 2, wherein a center of the lower inflatable envelope is formed with a depression for accommodating and locating a wearer's head.

4. Ready safety helmet as claimed in claim 1, wherein the inflatable envelope is integrally formed and overlaid on the upper and lower faces of the cover boards, one single nozzle being disposed on a certain portion of the envelope for inflating or deflating the envelope.

5. Ready safety helmet as claimed in claim 1, wherein a protective spectacle is disposed on front side of the hinged edges of the cover boards for protecting the eyes of a user.

6. Ready safety helmet as claimed in claim 1, wherein fastening straps are disposed between the cover boards for fastening the helmet on a user's head.

7. Ready safety helmet as claimed in claim 2, wherein fastening straps are disposed between the cover boards for fastening the helmet on a user's head.

8. Ready safety helmet as claimed in claim 3, wherein fastening straps are disposed between the cover boards for fastening the helmet on a user's head.

9. Ready safety helmet as claimed in claim 4, wherein fastening straps are disposed between the cover boards for fastening the helmet on a user's head.

10. Ready safety helmet as claimed in claim 5, wherein fastening straps are disposed between the cover boards for fastening the helmet on a user's head.

11. Ready safety helmet as claimed in claim 1, wherein fastening straps are disposed on the inflatable envelope.

12. Ready safety helmet as claimed in claim 2, wherein fastening straps are disposed on the inflatable envelope.

13. Ready safety helmet as claimed in claim 3, wherein fastening straps are disposed on the inflatable envelope.

14. Ready safety helmet as claimed in claim 4, wherein fastening straps are disposed on the inflatable envelope.

15. Ready safety helmet as claimed in claim 5, wherein fastening straps are disposed on the inflatable envelope.

16. Ready safety helmet as claimed in claim 1, wherein the nozzle is connected to an automatic inflator.

17. Ready safety helmet as claimed in claim 2, wherein the nozzle is connected to an automatic inflator.

18. Ready safety helmet as claimed in claim 3, wherein the nozzle is connected to an automatic inflator.

19. Ready safety helmet as claimed in claim 4, wherein the nozzle is connected to an automatic inflator.

20. Ready safety helmet as claimed in claim 5, wherein the nozzle is connected to an automatic inflator.

21. Ready safety helmet as claimed in claim 6, wherein the nozzle is connected to an automatic inflator.

22. Ready safety helmet as claimed in claim 7, wherein the nozzle is connected to an automatic inflator.

23. Ready safety helmet as claimed in claim 8, wherein the nozzle is connected to an automatic inflator.

24. Ready safety helmet as claimed in claim 9, wherein the nozzle is connected to an automatic inflator.

25. Ready safety helmet as claimed in claim 10, wherein the nozzle is connected to an automatic inflator.

26. Ready safety helmet as claimed in claim 11, wherein the nozzle is connected to an automatic inflator.

27. Ready safety helmet as claimed in claim 12, wherein the nozzle is connected to an automatic inflator.

28. Ready safety helmet as claimed in claim 13, wherein the nozzle is connected to an automatic inflator.

29. Ready safety helmet as claimed in claim 14, wherein the nozzle is connected to an automatic inflator.

30. Ready safety helmet as claimed in claim 15, wherein the nozzle is connected to an automatic inflator.

* * * * *